United States Patent [19]

Kolibas

[11] 3,931,793

[45] Jan. 13, 1976

[54] PRESSURE FIXING OF TONER POWDER IMAGES

[75] Inventor: James A. Kolibas, Broadview Heights, Ohio

[73] Assignee: Addressograph Multigraph Corporation, Cleveland, Ohio

[22] Filed: Feb. 4, 1974

[21] Appl. No.: 439,270

[52] U.S. Cl. ..... 118/637; 118/114; 100/176

[51] Int. Cl.[2] ..... B05B 5/02

[58] Field of Search ..... 118/114, 116, 224, 226, 118/637; 29/110; 271/272, 273, 274; 144/282, 249 R, 250 R; 100/155 R, 176

[56] References Cited

UNITED STATES PATENTS

| | | | |
|---|---|---|---|
| 1,568,605 | 1/1926 | Hough | 118/224 X |
| 3,013,526 | 12/1961 | Crumrine et al. | 118/114 |
| 3,071,070 | 1/1963 | Matthews et al. | 118/637 |
| 3,094,429 | 6/1963 | Howell | 118/637 |
| 3,498,215 | 3/1970 | Brinkman | 100/155 R |
| 3,554,098 | 1/1971 | Achepohl et al. | 100/176 |

*Primary Examiner*—Mervin Stein
*Assistant Examiner*—Steven Hawkins
*Attorney, Agent, or Firm*—Russell L. Root

[57] ABSTRACT

Electrostatic toner powder images on copy sheets are fixed by the application of pressure alone, using sets of mating rollers so arranged that each set nips and treats a narrow track on the sheet, and also so arranged that the treated tracks have slightly overlapping margins whereby the full area of the sheet is treated in the process.

3 Claims, 4 Drawing Figures

PRESSURE FIXING OF TONER POWDER IMAGES

BACKGROUND OF THE INVENTION

This invention relates to fixing of toner powder images on copy sheets, such as those created by electrostatic copying techniques, and especially to he fixing of such images by pressure application without applied heat.

The fixing by pressure alone of electrostatically held toner images on narrow strips by using hard metal, usually steel, rollers has been described in an article by Bolton and Goetz in *Photographic Engineering*, 1956, Vol. 7 Nos. 3 and 4, pages 137 to 146, esp. page 143, and an improved form adaptable for use with wider sheets, such as normal letter size sheets, has been described in British Pat. specification No. 1,226,200.

OUTLINE OF THE PRESENT INVENTION

Experience with pressure fixing devices as shown in the British Pat. specification No. 1,226,200 has demonstrated that in order to successfully fix toner powder images on strips or sheets of substantial width, the pressure rollers must be built with great rigidity to minimize bowing effects under the loadings involved. In addition, since each roll has only two bearings these must be of massive construction to withstand the loading which is, of course, half the force applied to the entire roll. While this type of construction is feasible and provides adequate and effective equipment, the present invention makes possible equivalent results without the necessity for such high strength, massive construction.

For the purposes of this specification, "substantial width" means sheets of 5″ width or more, and includes sheets of "letter size," i.e. sheets of 8½ to 9 inches in width as well as wider sheets.

In particular the present invention provides for fully fixing the image on a sheet of substantial width by passing the sheet into an array of roller segments, each much shorter than the sheet width, but so arranged that the roller pairs will nip portions of the sheet only. The portions or paths thus treated are slightly overlapping so that the entire sheet, or at least a broad continuous area thereof, can be fixed on a single pass.

DESCRIPTION OF THE PREFERRED EMBODIMENTS

Figure 1:
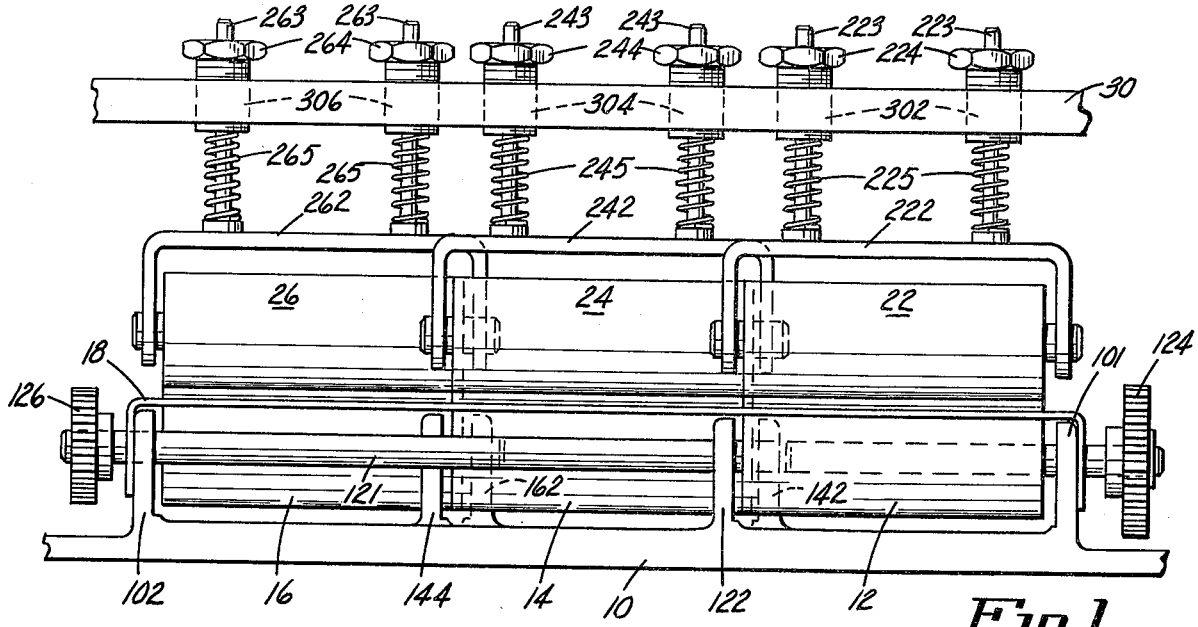
FIG. 1 is an end elevation of a pressure fixing device according to the present invention.
Figure 2:
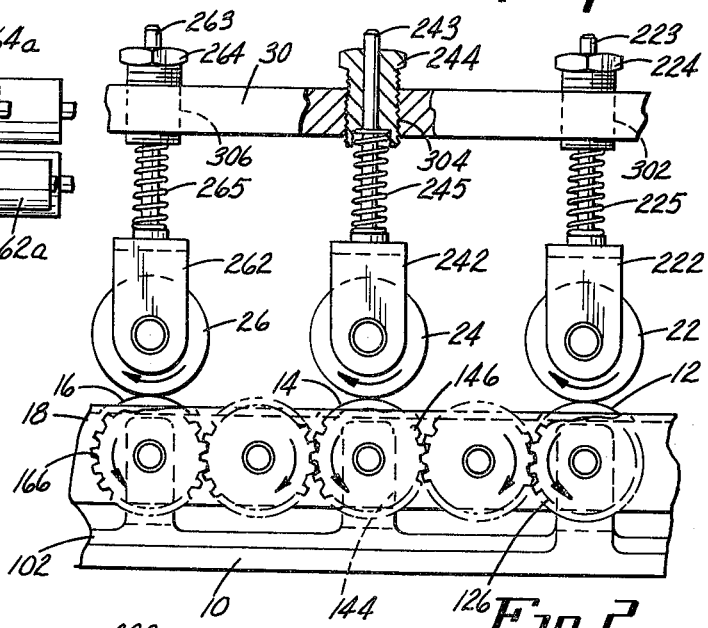
FIG. 2 is a left side elevation of a portion of the device shown in FIG. 1 with parts broken away to illustrate the mounting of one of the upper rolls.

Referring to FIGS. 1 and 2, there is provided a base casting 10 which supports the lower roller of each set. The casting is preferably provided with integral upstanding side flanges 101 and 102, and with integral posts, which carry the bearings for supporting the rollers. For example the first lower roller 12 includes a shaft 121 which extends the full width of the machine. The shaft 121 is rotatably supported in bearings of customary type mounted in the flanges 101 and 102 and the integral post 122. Post 122 and flange 101 embrace the roller 12 closely and provide its primary support. One end of shaft 121 carries a gear 124 which receives the power input (not shown) to provide rotation to the roller 12. The other end of shaft 121 carries a gear 126 whose purpose will presently appear.

A second lower roller 14 is arranged similarly in some respects to roller 12 and its shaft 141 is rotatably supported by bearings in the flange 102 and integral posts 142 and 144, the latter two embracing and supporting the roller. Shaft 141 carries at its left hand end (FIG. 3) a gear 146. A third lower roller 16 on shaft 161 is similarly mounted, but in this instance requires only the flange 102 and integral post 162 for support, the shaft carrying a gear 166 at its left end.

Figure 3:
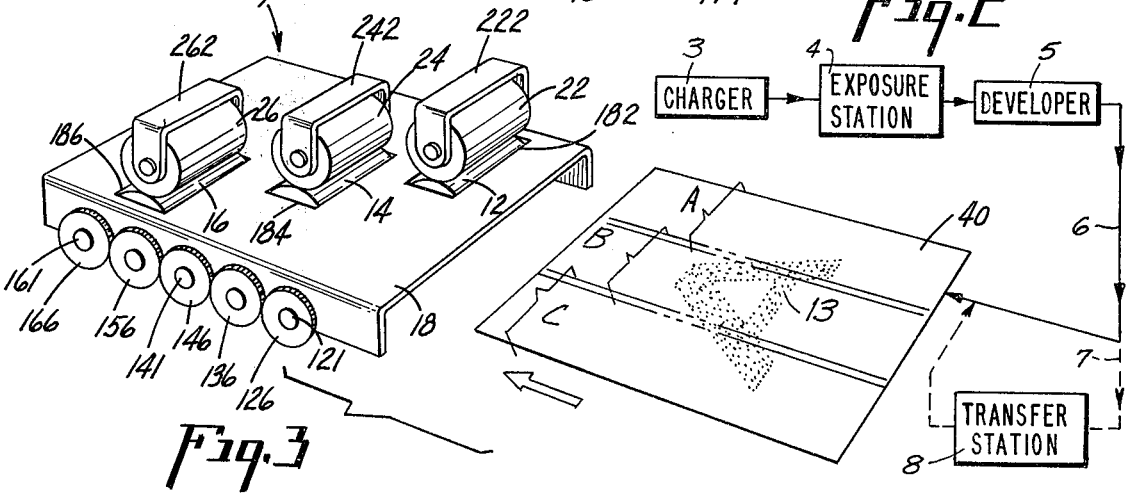
FIG. 3 is a perspective view of the device of FIGS. 1 and 2 with parts omitted for clarity, illustrating the manner of use and including the other stations of an electrostatic copying machine shown in schematic or block diagram form.

As clearly seen in FIGS. 1 to 3, the rollers 12, 14 and 16 are so arranged that their ends are slightly overlapping when viewed in a direction normal to the axis, and the base is completed by a housing or guide plate 18 which is provided with closely fitting openings 182, 184, and 186 allowing the rollers 12, 14 and 16 respectively to project just above the surface of plate 18.

Idler gear 136 meshes with gear 126 and 146, and idler gear 156 with gears 146 and 166, so that all shafts 121, 141, 161 and their corresponding rollers will be driven in the same direction at the same speed whenever the input gear 124 is driven.

Matching the rollers 12, 14 and 16 respectively are upper rollers 22, 24 and 26, which have shafts 221, 241, and 261 rotatably supported by conventional bearings in the arms of yokes 222, 242, and 262 respectively. Since the yokes are all similar, the yoke 242 and its mounting will be described in detail, with the understanding that a corresponding description and an analogous numeral identification applies to each of the others.

Overlying the base casting 10 is a structural member 30, shown in the form of a plate, which is immovably anchored by suitable means, not specifically shown, to the frame of the machine. The plate 30 is provided with two openings 304 which are internally threaded, and which receive therein threaded bushings 244. The bushings 244 receive, with a sliding fit, a pair of posts 243 which are integrally attached to the yoke 242, and each post is surrounded by a compression spring 245 which is in contact with the top of the yoke 242 at its lower end, and at its upper end is in contact with the bottom of the threaded bushing. The springs 245 urge the yoke 242 and its roller 24 into pressure contact with the underlying roller 14, and the loading may be adjusted to the desired value by means of the threaded bushings 244.

FIG. 3 helps to illustrate the use of the device. Assuming that the proper loading has been set on the rollers and that they have been set in rotation, a copy sheet 40 having thereon a powder image (not actually shown, but of the kind which is normally deposited in an electrostatic copier) is passed from the position shown towards the left between the roller pairs so that its surface is subjected to the squeezing action of the rollers. The roller pair 12, 22 will treat the sheet in a path designated A, the roller pair 41, 24 in a path designated B, and the roller pair 16, 26 in a path designated C. As can be seen, these paths are overlapping so that the entire sheet area will be pressure treated and the image on its surface thereby caused to be fixed.

In addition to the fact that the short rollers shown are not affected by the severe bowing tendencies to which longer rollers are subject, it can be demonstrated that their individual loading values will be greatly reduced. For example, if we assume that the total span of the sheet is 9 inches and each roller therefore treats approximately 3 inches of sheet width, then the calculated loadings would be as follows.

Assuming for purpose of illustration, one fairly common value of roller loading for pressure fixing, namely 300 pounds per lineal inch (pli), a roll of full sheet width would have to receive a force of $9 \times 300 = 2700$ pounds and each bearing would thus sustain a loading of 1350 pounds. However, when constructed according to the invention, each 3-inch roller pair would need to apply $3 \times 300$ pli $= 900$ pounds, so that the individual load at any one bearing would be only 450 pounds.

As a consequence of the above factors all members, namely rollers, shafts and bearings, can be much reduced in diameter and bulk without impairing the effectiveness of the equipment.

FIG. 3 includes the various aspects of conventional electrostatic copier equipment illustrated in schematic or block diagram form, and helps to illustrate the use of the device of FIGS. 1 and 2. The process of forming the powder image may be carried out in the usual manner wherein a member or sheet carrying a photoconductive layer is automatically fed past a charger 3 to receive a uniform static charge on its surface, is then automatically fed to an exposure station 4 where it is exposed to a light and shadow pattern corresponding to the desired image, then is automatically fed to developer equipment 5 where the latent image is developed with a toner powder according to known procedures and finally fed directly (as by path 6) to a fixing station 9 where it is processed as previously described. In the alternative, a latent electrostatic image similarly formed on the photoconductive layer of a member or sheet may be developed with toner, and the toner image thus formed transferred therefrom to another sheet or substrate as both are fed automatically (as by alternate path 7) through a transfer station 8. In any event, the resulting product is a flexible sheet or substrate 11 with a loosely held image 13 defined by toner powder on its surface, being automatically fed to the fixing station 9 where it is processed as previously described.

In addition to the typical processes above described, it will be readily appreciated that other techniques for depositing toner particles on a substrate under the control of an electrostatic image pattern have been developed, and any of these are usable in conjunction with the fixing technique herein described.

While the foregoing description is based on the use of three roller pairs, each approximately three inches in length, it will be understood that more rollers may be used and that the rollers may be made even shorter if desired with corresponding reduction in the need to sustain heavy loadings and a consequent reduction in part size. In most applications, it is practical and feasible to use rollers up to a limit of about three inches in length. Above that value the benefits are reduced and tend to be more than offset by the additional complexity of the structure, and rollers of shorter length, in the neighborhood of 1 inch, are preferable.

With the shorter rollers which characterize this invention it is now possible to use hard metal rollers in the fixing of images on broad letter-size sheets if desired. However, it is still deemed preferable to use rollers of material having a modulus of elasticity in compression in the range of 100,000 p.s.i. to 2,000,000 p.s.i. as set forth in said British specification 1,226,200.

Figure 4:
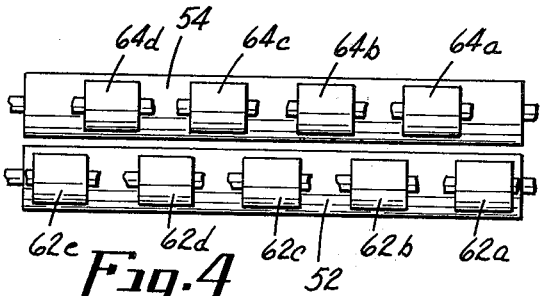
FIG. 4 is a diagramatic plan illustrating an alternative way of arranging the roller segments to achieve the benefits of the invention.

In situations where machine dimensions in the direction of sheet travel are restricted, it may be desirable to use a slightly different roller arrangement as illustrated diagrammatically in FIG. 4. In this arrangement there are used two long bottom rollers 52 and 54. Cooperating with roller 52 is a series of upper roller segments 62*a*, 62*b*, 62*c*, 62*d* and 62*e* spaced apart slightly less than the length of one roller segment. Cooperating with rollers 54 is a series of upper roller segments 64*a*, 64*b*, 64*c* and 64*d* spaced similarly to the segments 62*a–e*, but interspersed between them so as to provide a slight overlap of treatment area at each end.

With the arrangement just described the entire fixing treatment can take place within a length of two roller diameters in the direction of sheet feed. The fact that the lower rolls are continuous does not seriously affect the beneficial aspect of the invention because the rolls may be allowed to take a fairly significant bow without detriment inasmuch as they will be faithfully followed by the roller segments of the upper row. In any case, however, it is entirely feasible to maintain the axes of the lower rolls straight by placing back-up bearing rolls or bearings at locations between those occupied by the cooperating upper rollers, so that a low rigidity design and minimum dimensions for the lower roller are still readily attainable.

What is claimed is:

1. Apparatus for providing a permanent image on a substrate of substantial width, wherein the image is a fixed powder image of electroscopic toner powder, comprising means for fixing the toner powder image to said substrate, which means consists essentially of means establishing a feed path for the workpiece, a plurality of pairs of unheated pressure rollers disposed on parallel axes along said feed path and each having a contact nip, in which the contact nip of each pair of rollers is no more than about three inches in length, and thereby establishes a treatment track of its own width substantially narrower than the width of a workpiece to be treated, in which each roller pair is individually loaded, in which the pairs are offset and so disposed as to produce overlap between the treatment tracks of the roller pairs, and in which the pairs are sufficient in number and so arranged as to produce a complete uninterrupted pressure treatment area of the desired width as the workpiece is fed between the rollers.

2. Apparatus as set forth in claim 1 in which at least one roller of each pair is of a material having a modulus of elasticity in compression of between 100,000 psi. and 2,000,000 psi.

3. Apparatus as set forth in claim 1 in which there are two sets of rollers, each set comprising a long common roller cooperating with a plurality of spaced coaxial roller segments, and in which the plurality of segments cooperating with one of said common rollers is arranged to span the gaps between the segments cooperating with the other of said common rollers.

* * * * *